United States Patent [19]

Kearney

[11] 4,380,728

[45] Apr. 19, 1983

[54] CIRCUIT FOR GENERATING A TEMPERATURE STABILIZED OUTPUT SIGNAL

[75] Inventor: Mark B. Kearney, Kokomo, Ind.

[73] Assignee: General Motors Corporation, Detroit, Mich.

[21] Appl. No.: 265,205

[22] Filed: May 19, 1981

[51] Int. Cl.[3] ..... G05F 1/58

[52] U.S. Cl. ..... 323/281; 323/313; 323/907; 361/152

[58] Field of Search ..... 323/269, 273280, 281, 323/312-314, 907, 268; 361/152, 154

[56] References Cited

U.S. PATENT DOCUMENTS

| | | | |
|---|---|---|---|
| 3,536,986 | 10/1970 | Perlman | 323/312 |
| 3,887,863 | 6/1975 | Brokaw | 323/314 |
| 4,064,448 | 12/1977 | Eatock | 307/297 |

FOREIGN PATENT DOCUMENTS

| | | | |
|---|---|---|---|
| 2239717 | 2/1975 | France | 323/273 |
| 547749 | 5/1977 | U.S.S.R. | 323/280 |

OTHER PUBLICATIONS

IBM Technical Disclosure Bulletin, vol. 22, No. 12, pp. 5252, 5253, May 1980.

*Primary Examiner*—William H. Beha, Jr.
*Attorney, Agent, or Firm*—Howard N. Conkey

[57] ABSTRACT

A temperature stabilized voltage reference is generated based on the difference in the base to emitter voltages of a pair of transistors operating at different current densities which is summed with a voltage that is a predetermined fraction of one of the base emitter voltages. This voltage is utilized to provide for a constant current through a load by adjusting the current through a sense resistor to the value of the temperature stabilized voltage.

5 Claims, 1 Drawing Figure

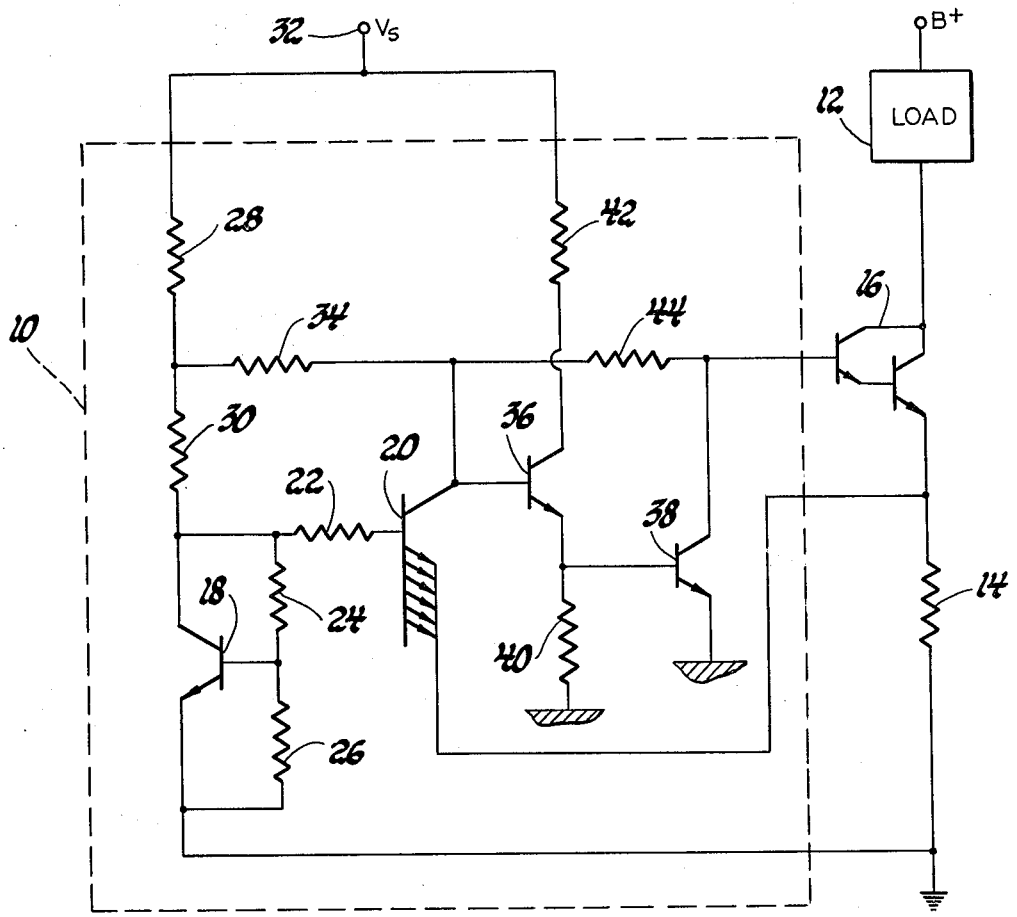
32
Vs
B+
12
LOAD
28
42
16
10
34
44
30
36
20
22
38
18
24
14
40
26

CIRCUIT FOR GENERATING A TEMPERATURE STABILIZED OUTPUT SIGNAL

This invention relates to a monolithic integrated circuit for producing a constant temperature stabilized output signal.

In many circuit applications such as in voltage supplies or in circuits for supplying constant current through a load, a low voltage reference value is desired. For example, constant currents are often generated with a feedback system in which the generated current is passed through a sense resistor to yield a voltage proportional to the current level. This voltage may then be compared to a fixed reference voltage and negative feedback applied to correct any error in the generated current. In high current applications, it is often desirable to limit the reference voltage to a small value to minimize power dissipation in the sense resistor. A smaller value of the reference voltage also increases the dynamic voltage range at the collector of the driver transistor.

It is further desirable in many circuit applications to maintain the low voltage reference substantially constant independent of temperature variations. Accordingly, it is the primary object of this invention to provide an improved voltage regulator circuit for generating a constant low voltage value that is substantially independent of temperature variations.

It is another object of this invention to provide a constant current error amplifier having an internal reference voltage generator providing a low reference voltage value substantially independent of temperature variations.

These and other objects of this invention may be best understood by reference to the drawing which illustrates a constant current error amplifier including an internal reference voltage generator for maintaining a constant current through an external load in accord with the principles of this invention.

Referring to the drawing, a monolithic integrated circuit 10 functions to control the current through an external load 12 to a constant value independent of temperature by maintaining the voltage across a sense resistor 14 at a constant value independent of temperature. In this regard, an output Darlington transistor 16 is series coupled with the load 12 and the sense resistor 14 between a supply voltage terminal B+ and ground and is controlled in accord with the sensed voltage across the sense resistor 14 to maintain the voltage constant thereby producing a constant current through the load 12. In one application, the load 12 may be a fuel injector solenoid with the external power supply voltage B+ being provided by a vehicle battery.

It is desirable to limit the voltage across the resistor 14 when the current to the load 12 is at the desired level to a small value in order to minimize the power dissipation in the sense resistor 14. In one embodiment, a desired regulated current level of 1 amp with a sense voltage of 0.10 volts across a 0.1 ohm sense resistor 14 is provided.

The emitter of an NPN transistor 18 is coupled to the grounded side of the sense resistor 14 and its base is coupled to the base of a second NPN transistor 20 through a compensating resistor 22 and a resistor 24. A resistor 26 is coupled between the base and emitter of the transistor 18. The emitter of the transistor 20 having an area greater than the area of the emitter of the transistor 18 is coupled to the ungrounded side of the sense resistor 14. In this embodiment the emitter area of the transistor 20 is six times the emitter area of the transistor 18.

A supply circuit for biasing the transistors 18 and 20 conductive includes resistors 28 and 30 which supply current from a terminal 32, to which a regulated voltage supply $V_s$ is applied, to the collector of the transistor 18 and the base of the transistor 20 through the compensating resistor 22. The resistor 28 and a resistor 34 supply current from the terminal 32 to the collector of the transistor 20.

A pair of transistors 36 and 38 provide the necessary inversion and current amplification for driving the external Darlington transistor 16. In this respect, the emitter of the transistor 36 is coupled to the base of the transistor 38 and to a grounded substrate of the integrated circuit 10 through a resistor 40. The collector of the transistor 36 is coupled to the regulated voltage supply terminal 32 through a resistor 42. The emitter of the transistor 38 is coupled to the grounded substrate of the integrated circuit 10 and its collector, forming the output of the inverter and amplifying stage, is coupled to the base of the Darlington transistor 16. A resistor 44 coupled between the input and output of the inverter amplifying stage provides for limiting of the small signal open loop gain of the circuit.

In general, neglecting of the present time the effect of the resistor 22, the voltage across the sense resistor 14 is comprised of the voltage drop across the resistor 24 and the difference in base-emitter junction voltages of the transistors 18 and 20. The voltage drop across the resistor 24 (neglecting error due to the base current of the transistor 18) is the ratio of the resistance of the resistor 24 to the resistance of the resistor 26 times the base-emitter junction voltage of the transistor 18 and has a linear, negative temperature coefficient. The difference in the base-emitter junction voltages of the transistors 18 and 20 is related to the ratio of the irrespective current densities and has a linear, positive temperature coefficient. By proper selection of the emitter area ratios and the resistor ratios, the sum of the positive and negative temperature coefficient signals yield a precise thermally stable reference voltage to be maintained across the sense resistor 14.

The value of the reference voltage, hereinafter referred to as $V_R$, which is to be maintained across the sense resistor 14, is determined by adding the voltage potentials around the loop from the grounded side of the sense resistor 14 to its ungrounded side. This yields the expression for the voltage $V_R$ as follows:

$$V_R = V_{ce18} - V_{be20} \quad (1)$$

where $V_{ce18}$ is voltage from collector to emitter of the transistor 18 and $V_{be20}$ is the base-emitter junction voltage of the transistor 20.

Neglecting error due to the base current of the transistor 18, a $V_{be}$ multiplier composed of the transistor 18 and the resistors 24 and 26 is formed such that:

$$V_{ce18} = V_{be18}(1 + R_{24}/R_{26}) \quad (2)$$

where $R_{24}$ is the resistance of the resistor 24 and $R_{26}$ is the resistance of the resistor 26.

Therefore:

$$V_R = V_{be18}(1 + R_{24}/R_{26}) - V_{be20} \quad (3)$$

-continued $$= V_{be18} + (R_{24}/R_{26})V_{be18} - V_{be20}$$

$$= (R_{24}/R_{26})V_{be18} + (V_{be18} - V_{be20})$$

$$= (R_{24}/R_{26})V_{be18} + (kT/q)\ln(J_{18}/J_{S18}) - (kT/q)\ln(J_{20}/J_{S20})$$

where k is equal to Boltzmann's constant, T is the absolute temperature of the transistor operation, q is the charge of an electron, $J_{18}$ and $J_{20}$ are the respective current densities of the transistors 18 and 20 and $J_{S18}$ and $J_{S20}$ are the respective saturation current densities of the transistors 18 and 20.

Since the transistors 18 and 20 are matched monolithic transistors, the assumption that their saturation current densities are equal is valid and the equation 3 above can be expressed as follows:

$$V_R = (R_{24}/R_{26})V_{be18} + (kT/q)\ln(J_{18}/J_{20}) \quad (4)$$

$$= (R_{24}/R_{26})V_{be18} + (kT/q)\ln(I_{e18}/A_{18} \cdot A_{20}/I_{e20})$$

where $I_{e18}$ and $I_{e20}$ are the respective emitter currents of the transistors 18 and 20 and $A_{18}$ and $A_{20}$ are the respective emitter areas of the transistors 18 and 20.

As can be observed from the equation 4, the reference voltage $V_R$ is determined by the summation of two terms, the first of which has a linear negative temperature coefficient and the second of which has a linear positive temperature coefficient.

If the ratios $R_{24}/R_{26}$, $I_{e18}/I_{e20}$ and $A_{20}/A_{18}$ can be properly determined such that the negative and positive temperature coefficient terms of equation 4 balance one another, then a temperature independent reference voltage $V_R$ will result.

Differentiation of equation 4 with respect to temperature yields:

$$dV_R/dT = (R_{24}/R_{26})dV_{be18}/dT + \frac{d}{dT}(kT/q \cdot \ln(I_{e18}/I_{e20} \cdot A_{20}/A_{18})). \quad (5)$$

A good approximation for $dV_{be}/dT$ at a constant collector current is:

$$dV_{be}/dT = -(V_{go} - V_{be}@300^\circ\text{ K.})/300^\circ\text{ K.} \quad (6)$$

where $V_{go}$ is the extrapolated energy band gap voltage of the semiconductor material from which the transistors 18 and 20 are made at absolute zero. Practically, this extrapolated energy band gap voltage yields an accurate function for the base-emitter junction voltage of a silicon transistor with respect to temperature if a value of 1.25 volts is chosen.

By substituting equation 6 into equation 5 and setting the derivative of the reference voltage $V_R$ with respect to temperature equal to zero, the ratio $R_{18}/R_{20}$ for a temperature stable reference voltage may be determined:

$$dV_R/dT = (R_{24}/R_{26})(-1.25\text{V} + V_{be}@300^\circ\text{ K.})/300^\circ\text{ K.} + (k/q)\ln(I_{e18}/I_{e20} \cdot A_{20}/A_{18}) = 0 \quad (7)$$

$$= (R_{24}/R_{26})(-1.25\text{V}/300^\circ\text{ K.}) + (R_{24}/R_{26})V_{be}@300^\circ\text{ K.}/300^\circ\text{ K.} + (300^\circ\text{ K} \cdot k/q)(\ln(I_{e18}/I_{e20} \cdot A_{20}/A_{18}))/300^\circ\text{ K.}$$

Therefore:

$$(R_{24}/R_{26})(1.25\text{V}) = (R_{24}/R_{26})(V_{be}@300^\circ\text{ K.}) + (kT/q)\ln(I_{e18}/I_{e20} \cdot A_{20}/A_{18})@300^\circ\text{ K.} = V_R@300^\circ\text{ K.} \quad (8)$$

Thus from equation 8, the ratio $R_{18}/R_{20}$ necessary for a temperature stable sense voltage may be shown to be:

$$R_{24}/R_{26} = V_R/1.25\text{V}. \quad (9)$$

From the equations 4 and 9, the product of the ratios $I_{e18}/I_{e20}$ and $A_{20}/A_{18}$ is:

$$(I_{e18}/I_{e20})(A_{20}/A_{18}) = \exp[V_R(1 - V_{be18}/1.25\text{V})/(kT/q)]. \quad (10)$$

where kT/q equals 0.026 volts at 300° K.

Assuming $V_{be18}$ is 0.7 volts, the expression for the product of the emitter current and emitter area ratios to obtain a reference voltage that is substantially temperature independent is:

$$(I_{e18}/I_{e20})(A_{20}/A_{18}) = \exp(16.92V_R). \quad (11)$$

Referring to the drawing and assuming a specific example where it is desired to maintain a constant current of 1 amp to the load 12 and it is desired to provide a sense voltage of 0.10 volts, a sense resistor 14 is provided having a resistance of 0.1 ohm. From equation 9, the ratio $R_{24}/R_{26}$ is determined to be 0.08 which may be provided by making resistor 24 340 ohms and the resistor 26 4,250 ohms. From equation 11, the product of the ratio of the emitter currents $I_{e18}/I_{e20}$ and the ratio of the emitter areas $A_{20}/A_{18}$ must be 5.43. Since in the embodiment of the drawing the emitter area of the transistor 20 is six times the emitter area of the transistor 18, the resistors 28, 30 and 34 must be selected so that $6(I_e/I_{e20})$ is equal to approximately 5.43. The resistor 22 in the base circuit of the transistor 20 provides compensation due to base current errors.

From the foregoing, it can be seen that any desired temperature independent reference voltage may be provided by selecting the ratios of the resistors 24 and 26 in accord with equation 9 and by providing an emitter current ratio and emitter area ratio product that satisfies the expression of equation 11. Advantageously, this voltage may be substantially less than the base-emitter junction voltage drop of a transistor to thereby minimize the power dissipation in a load impedance such as the sense resistor 14.

The foregoing description of a preferred embodiment for the purpose of illustrating the invention is not to be considered as limiting or restricting the invention, since many modifications may be made by the exercise of skill in the art without departing from the scope of the invention.

The embodiments of the invention in which an exclusive property or privilege is claimed are defined as follows:

1. A circuit for providing a voltage that is substantially independent of temperature variations, comprising in combination:

first and second transistors;

a first resistor coupled between the bases of the first and second transistors;

a second resistor coupled between the base and emitter of the first transistor;

a load impedance coupled between the emitters of the first and second transistors; and supply means effective to bias the first and second transistors conductive so that the emitter current density of the first transistor is greater than the emitter current density of the second transistor to produce a difference in the base-emitter voltages of the first and second transistors having a positive temperature coefficient, the voltage across the first resistor being proportional to the base-emitter voltage of the first transistor and having a negative temperature coefficient, whereby a substantially temperature independent voltage is provided across the load impedance that is the sum of the voltage across the first resistor having a negative temperature coefficient and the difference in the base to emitter voltages of the first and second transistors having a positive temperature coefficient.

2. A monolithic integrated circuit for producing a voltage $V_R$ that is substantially independent of temperature variations, comprising in combination:

first and second bipolar junction transistors having emitter areas $A_1$ and $A_2$, respectively;

a first resistor having a resistance $R_1$ coupled between the bases of the first and second transistors;

a second resistor having a resistance $R_2$ coupled between the base and emitter of the first transistor, the ratio $R_1/R_2$ being equal to $V_R/V_{go}$, where $V_{go}$ is the semiconductor energy band gap voltage extrapolated to absolute zero;

a load impedance coupled between the emitters of the first and second transistors; and supply means effective to bias the first and second transistors conductive to supply emitter currents $I_1$ and $I_2$, respectively, the product of the ratios $I_1/I_2$ and $A_2A_1$ being equal to $\exp[V_R(1-V_{be1}/V_{go})/(kT/q)]$ where $V_{be1}$ is the base to emitter voltage of the first transistor, k is Boltzmann's constant, T is the absolute temperature and q is the charge of an electron, whereby the voltage $V_R$ is produced across the load impedance and is substantially temperature independent.

3. A monolithic integrated circuit for producing a regulated output voltage $V_R$ across a load, comprising:

first and second matched bipolar junction transistors having emitter areas $A_1$ and $A_2$, respectively;

means connected in relation to the first and second transistors for operating such transistors so that they provide base-emitter junction voltage drops $V_{be1}$ and $V_{be2}$ and have emitter currents $I_{e1}$ and $I_{e2}$, respectively;

first and second resistors having resistance values $R_1$ and $R_2$, respectively;

means for connecting the first resistor in relation to the first transistor so as to develop across such first resistor a voltage drop of substantially $V_{be1}$;

means for connecting the second resistor in relation to the first resistor so as to develop across such second resistor a voltage drop of substantially $V_{be1}(R_2/R_1)$;

means for connecting the first and second resistors and the second transistor in a loop circuit with the load such that the output voltage $V_R$ is substantially equal to $V_{be1}(R_2/R_1)+(V_{be1}-V_{be2})$, the resistances $R_1$ and $R_2$ being such as to substantially satisfy the relation $R_2/R_1=V_R/V_{go}$ and the emitter currents $I_{e1}$ and $I_{e2}$ and the emitter areas $A_1$ and $A_2$ such as to substantially satisfy the relation $(I_{e1}/I_{e2})(A_2/A_1)=\exp[V_R(1-V_{be1}/V_{go})/(kT/q)]$ where $V_{go}$ is the semiconductor band gap voltage extrapolated to absolute zero, k is Boltzmann's constant, T is the absolute temperature and q is the charge of an electron, whereby the output voltage $V_R$ is substantially equal to $V_{go}(R_2/R_1)$ and is substantially independent of variations in temperature.

4. A monolithic integrated circuit for producing a constant predetermined load current $I_L$ in a load impedance, comprising in combination:

a voltage source coupled with the load impedance effective to supply current therethrough;

a sense resistor having a resistance $R_S$ series coupled with the load impedance, the voltage across the sense resistor having a value $V_S$ when the current through the load impedance is equal to the predetermined value $I_L$;

means effective to establish a reference voltage equal to the value $V_S$, said means including first and second bipolar transistor having emitter areas $A_1$ and $A_2$, respectively, a first resistor having a resistance $R_1$ coupled between the bases of the first and second transistors, a second resistor having a resistance $R_2$ coupled between the base and emitter of the first transistor, the ratio $R_1/R_2$ being equal to $V_S/V_{go}$, where $V_{go}$ is the semiconductor energy band gap voltage extrapolated to absolute zero, means effective to couple the emitter of the first transistor to the low voltage side of the sense resistor, means effective to couple the emitter of the second transistor to the high voltage side of the sense resistor, and supply means effective to bias the first and second transistors conductive to supply emitter currents $I_1$ and $I_2$, respectively, the product of the ratios $I_1/I_2$ and $A_2/A_1$ being equal to $\exp[V_S(1-V_{be1}/V_{go})/(kT/q)]$ where $V_{be1}$ is the base-to-emitter voltage of the first transistor, k is Boltzmann's constant, T is the absolute temperature and q is the charge of an electron, the sum of the voltages across the first and second resistors and the base-emitter junction voltage of the second transistor providing a temperature stabilized reference voltage equal to $V_S$; and amplifier means coupled with the collector of the second transistor effective to adjust the current through the load impedance when the voltage across the sense resistor deviates from the reference voltage in a sense tending to restore the voltage across the sense resistor to the reference voltage, whereby the current through the load impedance is maintained substantially at the value $I_L$ independent of temperature variations.

5. A monolithic integrated circuit for producing a constant predetermined load current $I_L$ in a load impedance, comprising in combination:

a voltage source coupled with the load impedance effective to supply current therethrough;

a sense resistor having a resistance $R_S$ series coupled with the load impedance, the voltage across the sense resistor having a value $V_S$ when the current through the load impedance is equal to the predetermined value $I_L$;

means effective to establish a reference voltage equal to the value $V_S$, said means including first and second matched bipolar junction transistors having emitter areas $A_1$ and $A_2$, respectively, means effective to couple the emitter of the first transistor to the low voltage side of the sense resistor, means effective to couple the emitter of the second transistor to the high voltage side of the sense resistor, means connected in relation to the first and second transistors for operating such transistors so that they provide base-emitter junction voltage drops $V_{be1}$ and $V_{be2}$ and have emitter currents $I_{e1}$ and $I_{e2}$, respectively, first and second resistors having resistance values $R_1$ and $R_2$, respectively, means for connecting the first resistor in relation to the first transistor so as to develop across such first resistor a voltage drop of substantially $V_{be1}$, means for connecting the second resistor in relation to the first resistor so as to develop across such second resistor a voltage drop of substantially $V_{be1}(R_2/R_1)$, and means for connecting the first and second resistors and the second transistor in a circuit such that the voltage between the emitters of the first and second transistors is substantially equal to $V_{be1}(R_2/R_1)+(V_{be1}-V_{be2})$, the resistances $R_1$ and $R_2$ being such as to substantially satisfy the relation $R_2/R_1=V_S/V_{go}$ and the emitter currents $I_{e1}$ and $I_{e2}$ and the emitter areas $A_1$ and $A_2$ being such as to substantially satisfy the relation $(I_{e1}/I_{e2})(A_2/A_1)=\exp[V_S(1-V_{be1}/V_{go})/(kT/q)]$ where $V_{go}$ is the semiconductor band gap voltage extrapolated to absolute zero, k is Boltzmann's constant, T is the absolute temperature and q is the charge of an electron, the voltage between the emitters of the first and second transistors comprising the reference voltage having the value $V_S$; and amplifier means coupled with the collector of the second transistor effective to adjust the current through the load impedance when the voltage across the sense resistor deviates from the reference voltage in a sense tending to restore the voltage across the sense resistor to the reference voltage, whereby the current through the load impedance is maintained substantially at the value $I_L$ independent of temperature variations.

* * * * *

UNITED STATES PATENT AND TRADEMARK OFFICE

CERTIFICATE OF CORRECTION

PATENT NO. : 4,380,728

DATED : April 19, 1983

INVENTOR(S) : Mark B. Kearney

It is certified that error appears in the above-identified patent and that said Letters Patent is hereby corrected as shown below:

Column 2, line 28, "of" (first occurrence) should read -- for --.

Column 4, lines 42 and 43, "$6(I_e/I_{e20})$" should read -- $6(I_{e18}/I_{e20})$ --.

Column 6, lines 4 and 5, after "$A_1$ and $A_2$" and before "such" insert -- being --.

Signed and Sealed this

*Eleventh* Day of *October 1983*

[SEAL]

*Attest:*

GERALD J. MOSSINGHOFF

*Attesting Officer*

*Commissioner of Patents and Trademarks*